US012326258B2

(12) United States Patent
Ryon et al.

(10) Patent No.: US 12,326,258 B2
(45) Date of Patent: Jun. 10, 2025

(54) LINE REPLACEABLE FUEL INJECTOR PANELS WITH SINGLE HATCH INSTALLATION

(71) Applicant: Collins Engine Nozzles, Inc., Des Moines, IA (US)

(72) Inventors: Jason A Ryon, Carlisle, IA (US); Brandon P. Williams, Johnston, IA (US)

(73) Assignee: Collins Engine Nozzles, Inc., Des Moines, IA (US)

( * ) Notice: Subject to any disclaimer, the term of this patent is extended or adjusted under 35 U.S.C. 154(b) by 0 days.

(21) Appl. No.: 18/425,207

(22) Filed: Jan. 29, 2024

(65) Prior Publication Data

US 2024/0271792 A1 Aug. 15, 2024

Related U.S. Application Data

(63) Continuation of application No. 18/109,593, filed on Feb. 14, 2023.

(51) Int. Cl.
*F23R 3/28* (2006.01)
*F23D 14/46* (2006.01)

(52) U.S. Cl.
CPC ..... *F23R 3/283* (2013.01); *F23D 14/46* (2013.01); *F23D 2206/10* (2013.01); *F23D 2900/14001* (2013.01)

(58) Field of Classification Search
CPC ..... F23R 3/283; F23R 3/002; F23R 2900/00017; F23R 3/60;
(Continued)

(56) References Cited

U.S. PATENT DOCUMENTS 4,180,972 A * 1/1980 Herman ..... F23R 3/60 60/754
4,446,693 A * 5/1984 Pidcock ..... F23R 3/002 60/757
(Continued)

FOREIGN PATENT DOCUMENTS

CA 2608479 A1 * 4/2008 ..... F23R 3/002
CN 219846591 U * 10/2023
(Continued)

OTHER PUBLICATIONS

Extended European Search Report for European Patent Application No. 24157661.0, dated Jul. 4, 2024, 8 pages.

*Primary Examiner* — Craig Kim
(74) *Attorney, Agent, or Firm* — Kinney & Lange, P.A.

(57) ABSTRACT

A system includes an engine case for a gas turbine engine defined around a longitudinal axis. An access opening is defined through the engine case for access from outside the engine case to a space inside the engine case. A combustor is housed in the space inside the engine case. The combustor includes an inner annular wall and an outer annular wall radially outboard from the inner annular wall. The inner annular wall includes a first rail on an upstream end thereof. The outer annular wall includes a second rail on an upstream end thereof. The first and second rails each include a respective access portion configured to receive line replaceable injector components from through the access opening of the engine case into the first and second rails to form a combustor dome of the combustor.

8 Claims, 5 Drawing Sheets

(58) Field of Classification Search
CPC .. F23R 2900/00005; F23R 2900/00018; F23R 2900/00019; F23K 2300/20; F23D 2900/00008; F23D 2213/00
See application file for complete search history.

(56) References Cited

U.S. PATENT DOCUMENTS

| | | | | |
|---|---|---|---|---|
| 4,466,240 | A | 8/1984 | Miller | |
| 7,757,495 | B2 * | 7/2010 | Bessagnet | F23R 3/60 60/800 |
| 9,791,153 | B2 * | 10/2017 | Dai | F23R 3/36 |
| 9,933,161 | B1 * | 4/2018 | Papple | F23R 3/283 |
| 9,982,890 | B2 * | 5/2018 | Papple | F23R 3/002 |
| 10,041,679 | B2 * | 8/2018 | Prociw | F02C 7/222 |
| 10,655,857 | B2 * | 5/2020 | Harding | F23R 3/20 |
| 10,727,656 | B2 * | 7/2020 | Waitkus | F01D 9/065 |
| 10,830,440 | B2 * | 11/2020 | Prociw | F23R 3/002 |
| 10,830,442 | B2 | 11/2020 | Berry et al. | |
| 11,125,436 | B2 * | 9/2021 | Baranowicz | F23R 3/60 |
| 11,293,640 | B2 * | 4/2022 | Hucker | F23R 3/002 |
| 11,408,609 | B2 | 8/2022 | Prociw et al. | |
| 11,555,450 | B1 * | 1/2023 | Ryon | F02C 7/141 |
| 11,761,634 | B2 * | 9/2023 | Prociw | F23R 3/283 60/39.19 |
| 2008/0236164 | A1 * | 10/2008 | Bunel | F23R 3/10 60/740 |
| 2009/0019856 | A1 * | 1/2009 | Commaret | F23R 3/002 60/722 |
| 2010/0095680 | A1 * | 4/2010 | Rudrapatna | F23R 3/06 60/754 |
| 2011/0088409 | A1 * | 4/2011 | Carlisle | F23R 3/283 29/700 |
| 2015/0135720 | A1 * | 5/2015 | Papple | F23R 3/50 60/759 |
| 2015/0354517 | A1 * | 12/2015 | Mansour | F23D 11/103 239/397.5 |
| 2016/0252252 | A1 * | 9/2016 | Dai | F23R 3/286 60/740 |
| 2016/0376997 | A1 | 12/2016 | Prociw | |
| 2016/0377292 | A1 * | 12/2016 | Prociw | F23R 3/283 60/753 |
| 2017/0059167 | A1 * | 3/2017 | Bloom | F23R 3/007 |
| 2017/0176010 | A1 | 6/2017 | Ryon et al. | |
| 2017/0248317 | A1 * | 8/2017 | Hannwacker | F23R 3/007 |
| 2017/0248320 | A1 * | 8/2017 | Hannwacker | F23R 3/14 |
| 2018/0031242 | A1 * | 2/2018 | Harding | F23R 3/002 |
| 2018/0073736 | A1 * | 3/2018 | Papple | F23R 3/283 |
| 2018/0094813 | A1 * | 4/2018 | Corsmeier | F23R 3/007 |
| 2019/0113233 | A1 * | 4/2019 | Snyder | F23R 3/283 |
| 2019/0309948 | A1 | 10/2019 | Prociw et al. | |
| 2020/0132303 | A1 | 4/2020 | Prociw et al. | |
| 2021/0003283 | A1 * | 1/2021 | Baranowicz | F23R 3/10 |
| 2022/0195940 | A1 * | 6/2022 | Ryon | F02C 7/264 |
| 2023/0265800 | A1 * | 8/2023 | Goy | F02C 9/263 60/506 |
| 2023/0280034 | A1 * | 9/2023 | Overman | F23R 3/50 60/737 |
| 2023/0332549 | A1 * | 10/2023 | Li | F02C 9/28 |

FOREIGN PATENT DOCUMENTS

| | | | | |
|---|---|---|---|---|
| GB | 2598782 | A * | 3/2022 | F02C 7/36 |
| WO | WO-2023203472 | A2 * | 10/2023 | G21B 3/004 |

* cited by examiner

LINE REPLACEABLE FUEL INJECTOR PANELS WITH SINGLE HATCH INSTALLATION

CROSS-REFERENCE TO RELATED APPLICATIONS

This is a continuation of U.S. patent application Ser. No. 18/109,593 filed Feb. 14, 2023, the content of which is incorporated by reference herein in its entirety.

BACKGROUND

1. Field

The present disclosure relates to fuel injection and combustion systems, and more particularly to fuel injection and combustion systems for gas turbine engines.

2. Description of Related Art

In current designs, fuel injectors can be line replaceable. However, the current state of the art requires the mechanical load to be carried by the case. This results in a large cantilevered fuel injector mass, and therefore requires substantial strength in the flange and feedarm of the injector to be strong enough to prevent fatigue.

In addition, the typical fuel injector requires burner seals to allow for axial and radial movement caused by a mismatch due to differential thermal expansion between the combustor and the engine case. This allows air to leak between injector and dome, reduces the amount of thermal cooling on the dome, and is a fretting point between the injector and burner seals.

The conventional techniques have been considered satisfactory for their intended purpose. However, there is an ever present need for improved systems and methods for line replaceable injection components such as in gas turbine engines. This disclosure provides a solution for this need.

SUMMARY

A system includes an engine case for a gas turbine engine defined around a longitudinal axis. An access opening is defined through the engine case for access from outside the engine case to a space inside the engine case. A combustor is housed in the space inside the engine case. The combustor includes an inner annular wall and an outer annular wall radially outboard from the inner annular wall. The inner annular wall includes a first rail on an upstream end thereof. The outer annular wall includes a second rail on an upstream end thereof. The first and second rails each include a respective access portion configured to receive line replaceable injector components from through the access opening of the engine case into the first and second rails to form a combustor dome of the combustor.

A plurality of fuel injector components can be assembled across the first and second rails to form a combustor dome at an upstream end of a combustion space defined between the inner and outer annular walls of the combustor. The access opening of the engine case and the fuel injector components can be configured so that the access opening is wide enough in a circumferential direction relative to the longitudinal axis to admit only one of the fuel injector components at a time. Aside from the access opening, the engine case can be devoid of other access openings therethrough in a region of the engine case extending fully around the engine case in a circumferential direction and extending in an axial direction relative to the longitudinal axis that is coextensive with the access opening. Each of the fuel injector components can include an inner edge with a circumferentially extending dovetail. The first rail can include a circumferentially extending dovetail slot. The dovetail of each of the fuel injector components can be engaged in the dovetail slot. The access portion of the first rail can include an interruption in the dovetail slot configured to receive the dovetail of one of the fuel injector components in a radial direction relative to the longitudinal axis, followed by circumferential insertion of the dovetail into the dovetail slot.

Each of the fuel injector components can include an outer edge with a circumferentially extending dovetail, wherein the second rail includes a circumferentially extending dovetail slot, and wherein the dovetail of each of the fuel injector components is engaged in the dovetail slot. The access portion of the second rail can include an interruption in the dovetail slot configured to receive the dovetail of one of the fuel injector components in a radial direction relative to the longitudinal axis, followed by circumferential insertion of the dovetail into the dovetail slot. The access portions of the first and second rails can be circumferentially aligned.

Each fuel injector component in the plurality of fuel injector components can include a combustor dome web portion extending from a radially inner dovetail to a radially outer dovetail and extending circumferentially form a first side dovetail to a second side dovetail. A fuel injector can be defined through the combustor dome web portion, wherein the fuel injector including passages for air and fuel injection into the combustion space. A fuel tube can extend radially outward from the fuel injector for fluid communication of fuel from an external source into the injector. The fuel tube can include a coiled section and a threaded fuel inlet fitting. A plurality of side seals can be included, wherein one of the side seals is sealingly engaged to the first side dovetail of one of the fuel injector components and to the second side dovetail of a circumferentially adjacent one of the fuel injector components.

The engine case can include an access hatch sealing closure of the access opening outboard of a final fuel injector component of the fuel injector components. A plurality of fuel connection ports can be defined through the engine case for connection of the fuel tubes of the fuel injection components to an external fuel manifold. One of the fuel connection ports can be defined through the access hatch for connection of the final fuel injector component to the external fuel manifold.

The external fuel manifold can have a respective connection branch that is configured to connect to each of the fuel injector components through a respective one of the fuel connection ports. A respective retaining nut can extend through each of the fuel connection ports. Each retaining nut can include threads configured to engage the threaded fuel inlet fitting of one of the fuel injector components, and to press the fuel inlet fitting into sealing engagement with one of the connection branches of the external fuel manifold.

A method of assembling a system for fuel injection in a gas turbine engine includes inserting a first fuel injector component radially inward through an access opening through an engine case, relative to a longitudinal axis defined by the engine case. The method includes engaging a dovetail of the first fuel injector component with a dovetail slot of a combustor wall and sliding the first injector component circumferentially, relative to the longitudinal axis, along the dovetail slot.

The method can include inserting, one at a time, a plurality of subsequent fuel injector components radially through the access opening, engaging, one at a time, a dovetail of each of the subsequent fuel injector components with the dovetail slot, and sliding each of the subsequent fuel injector components circumferentially along the dovetail slot, forming a combustor dome wall until there remains a gap in the combustor dome big enough for only one final fuel injector component. The method can include sliding a side seal radially over side dovetails of each adjacent pair of the fuel injector components through the access opening to provide sealing engagement between each adjacent pair of the fuel injector components.

The method can include inserting the final fuel injector component radially through the access opening, sliding radially through the access opening a first final side seal over side dovetails of the final fuel injector component and a first adjacent fuel injector component, sliding radially through the access opening a second final side seal over side dovetails of the final fuel injector component and a second adjacent fuel injector component circumferentially opposite the first adjacent fuel injector component, and sealing an access hatch over the access opening. The method can include connecting a fuel manifold to the first, subsequent, and final fuel injector components by sliding a respective retaining nut over a respective fuel manifold branch, threading the retaining nut to threads of a threaded fuel inlet fitting of one of the fuel injector components to press the fuel inlet fitting into sealing engagement with one of the connection branches of the external fuel manifold, for connection of each of the fuel injector components to the external fuel manifold through a respective fuel connection ports of the engine case.

A method of removing a line replaceable fuel injector component from a gas turbine engine includes sliding a first injector component circumferentially, relative to a longitudinal axis defined by an engine case, along a dovetail slot of a combustor wall. This method includes disengaging the dovetail of the first fuel injector component from the dovetail slot, and removing the first fuel injector component radially outward through an access opening through the engine case, relative to a longitudinal axis defined by the engine case.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
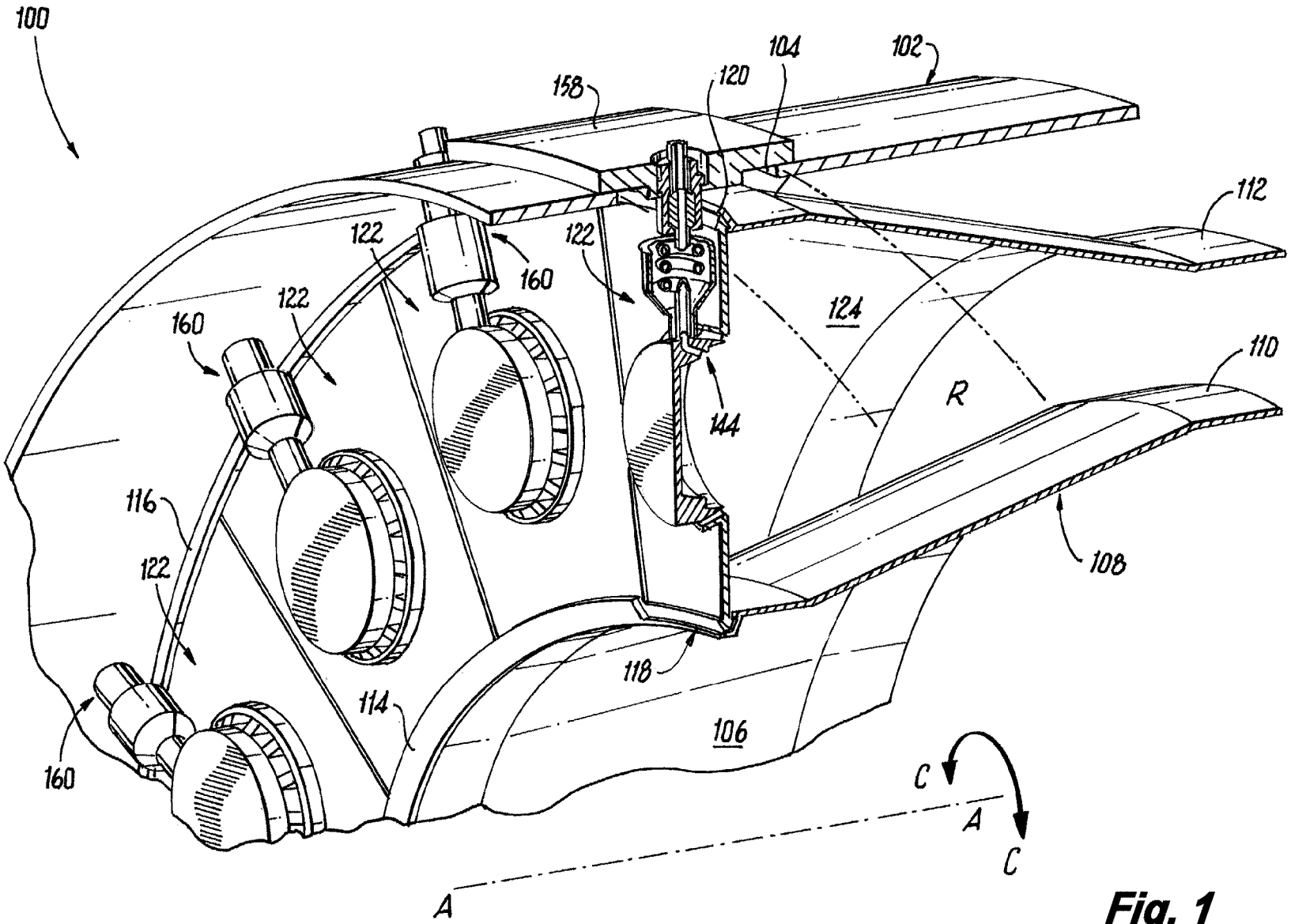
FIG. 1 is a schematic perspective view of an embodiment of a system constructed in accordance with the present disclosure, showing the engine case and combustor.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-5, as will be described. The systems and methods described herein can be used to provide for line replaceable fuel injection components in gas turbine engines.

The system 100 includes an engine case 102 for a gas turbine engine defined around a longitudinal axis A. An access opening 104 is defined through the engine case 102 for access from outside the engine case 102 to a space 106 inside the engine case 102. A combustor 108 is housed in the space inside the engine case. The combustor 108 includes an inner annular wall 110 and an outer annular wall 112 radially outboard from the inner annular wall 110. The inner annular wall 110 includes a first rail 114 on an upstream end thereof. The outer annular wall 112 includes a second rail 116 on an upstream end thereof. The first and second rails 114, 116 each include a respective access portion 118, 120 configured to receive line replaceable injector components 122 from outside the engine case 102, through the access opening 104, into the first and second rails 114, 116 to form a combustor dome, e.g. upstream wall of the combustor 108 connecting between the inner annular wall 110 and the outer annular wall 112.

A plurality of fuel injector components 122 are assembled across the first and second rails 114, 116 to form the combustor dome at an upstream end of a combustion space 124 defined between the inner and outer annular walls 110, 112 of the combustor 108. The access opening 104 of the engine case 102 and the fuel injector components 122 are configured, i.e. sized and shaped, so that the access opening 104 is wide enough in a circumferential direction C relative to the longitudinal axis A to admit only one of the fuel injector components 122 at a time. Aside from the access opening 104, the engine case 102 is devoid of other access openings 104 therethrough in a region R of the engine case 102 extending fully around the engine case 102 in the circumferential direction C and extending in an axial direction relative to the longitudinal axis A that is coextensive with the access opening 104, as indicated by the band between the dashed lines in FIG. 1, although there can be a plurality of fuel connection ports 160 as described below.

Figure 2:
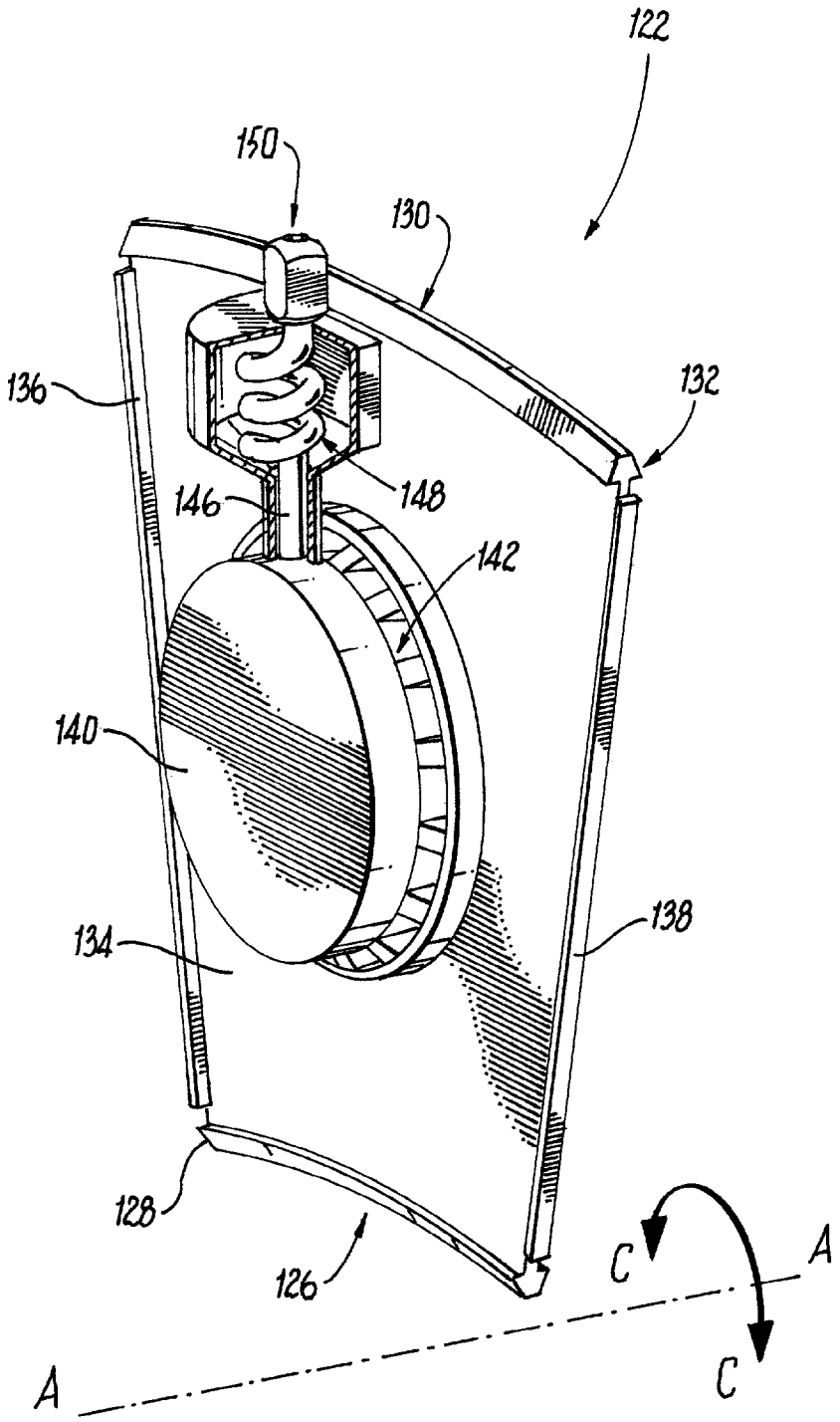
FIG. 2 is a schematic perspective view of a portion of the system of FIG. 1, showing one of the fuel injector components.

With reference now to FIG. 2, each of the fuel injector components 122 includes an inner edge 126 with a circumferentially extending dovetail 128, and an outer edge 130 with a circumferentially extending dovetail 132. Each fuel injector component 122 includes a combustor dome web portion 134 extending from the radially inner dovetail 128 to the radially outer dovetail 132 and extending circumferentially form a first side dovetail 136 to a second side dovetail 138. Those skilled in the art having had the benefit of this disclosure will readily appreciate that while dovetails and dovetail slots are disclosed herein, any other suitable type of overlapping joint can be used.

A fuel injector 140 is defined through the combustor dome web portion 134. The fuel injector 140 includes passages 142 for air and one or more passages 144 (labeled in FIG. 1) for fuel injection into the combustion space 124. A fuel tube 146 extends radially outward from the fuel injector 140 for fluid communication of fuel from an external source into the injector 140. The fuel tube includes a coiled section 148 for thermal compliance, and optionally a heat shield indicate in broken lines in FIG. 2. The fuel injector 140 can be integral with web/dome 134. The end of the fuel tube 146 includes a threaded fuel inlet fitting 150. A plurality of side seals 152 is included (labeled in FIG. 3). As shown in FIG. 4, one of the side seals 152 is sealingly engaged to the first side dovetail 136 of one of the fuel injector components 122 and to the second side dovetail 138 of a circumferentially adjacent one of the fuel injector components 122 for each adjacent pair of the fuel injector components going around the longitudinal axis A.

Figure 3:
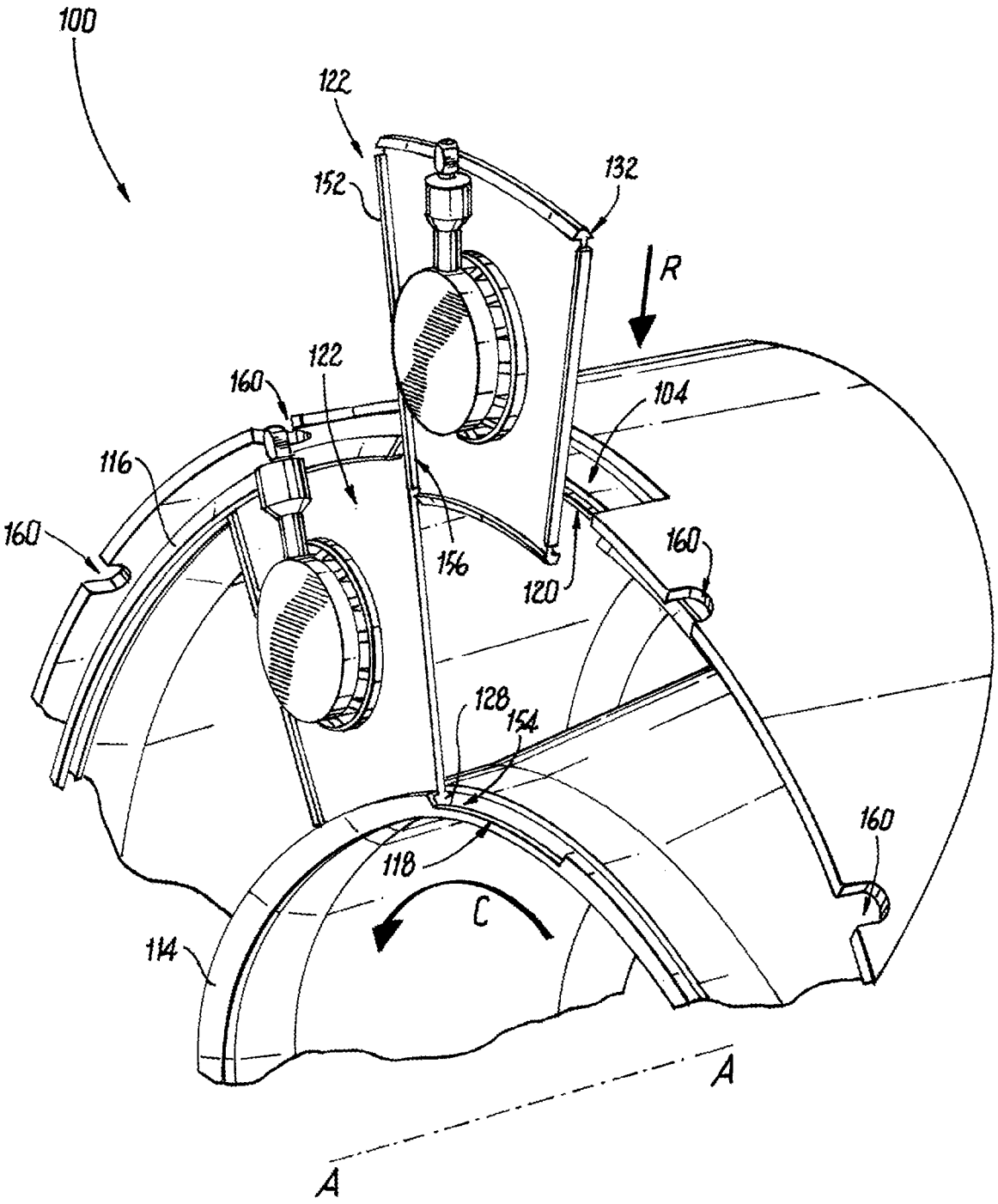
FIG. 3 is a schematic perspective view of a portion of the system of FIG. 1, showing installation of the fuel injector components to form the combustor dome.
Figure 4:
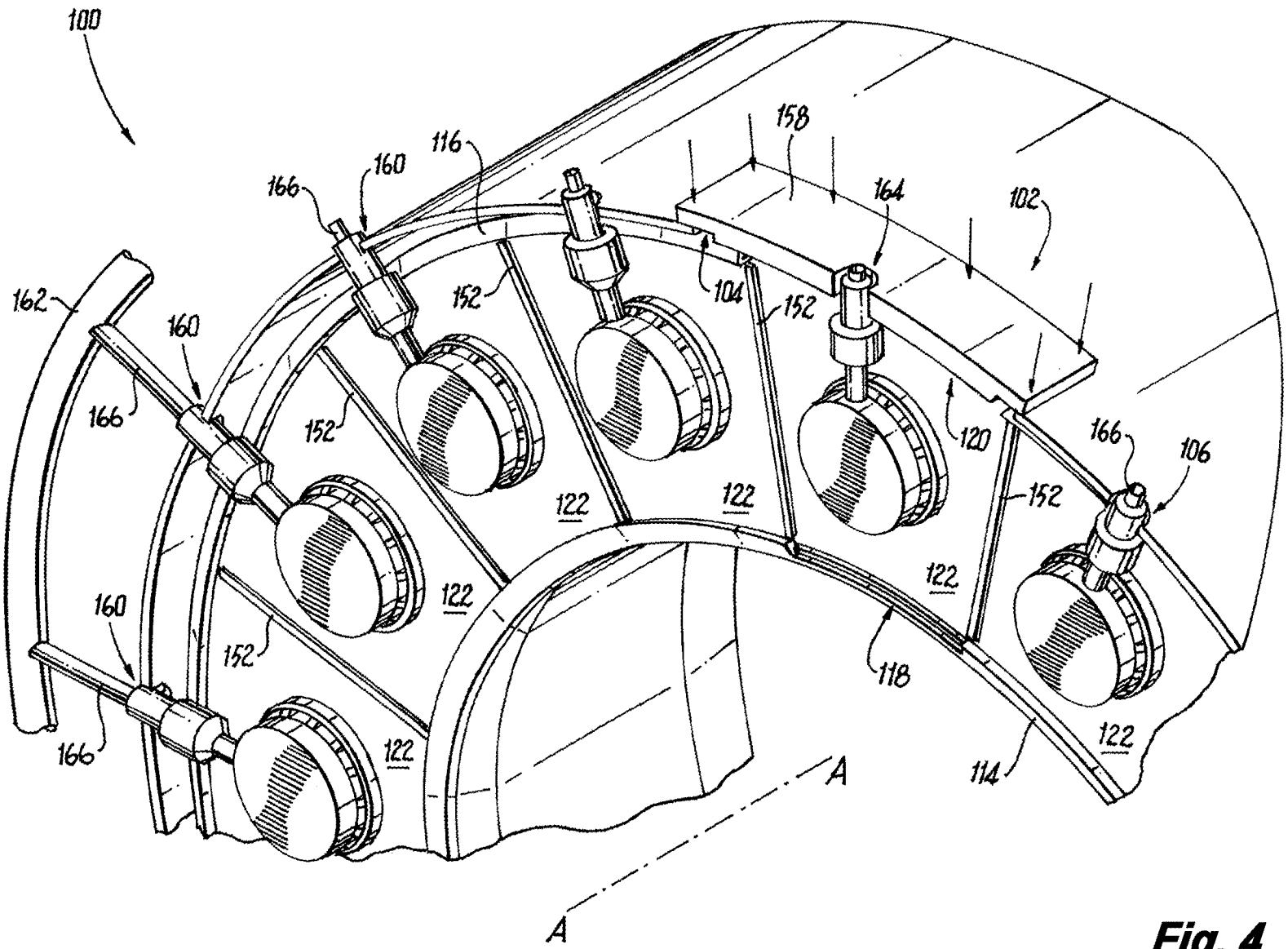
FIG. 4 is a schematic perspective view of the system of FIG. 1, showing closure of the access hatch.

With reference now to FIG. 3, the fuel injector components are configured for use as line replaceable units (LRUs). The first rail 114 (labeled in FIG. 1) includes a circumferentially extending dovetail slot 154 configured to receive the dovetails 128 of the fuel injector components 122. As shown in FIGS. 1 and 4, the dovetail 128 of each of the fuel injector components 122 is engaged in the dovetail slot 154 of the first rail 114. The access portion 118 of the first rail 114 includes an interruption in the dovetail slot 154 configured to receive the dovetail 128 of one of the fuel injector components 122 in a radial direction R relative to the longitudinal axis A, followed by circumferential insertion of the dovetail 128 into the dovetail slot 154, in the circumferential direction C. The large arrows in FIG. 3 indicate first the radial insertion of one of the fuel injector components 122 radially into the access portion 118 of the first rail 114, then the circumferential insertion of the dovetail 128 into the dovetail slot 154.

The second rail 116 includes a circumferentially extending dovetail slot 156, wherein the dovetail 132 of each of the fuel injector components 122 is engaged in the dovetail slot 156. The access portion 120 of the second rail 116 includes an interruption in the dovetail slot 156 configured to receive the dovetail 132 of one of the fuel injector components 122 in a radial direction R, followed by circumferential insertion of the dovetail 132 into the dovetail slot 156 much as described above. The access portions 118, 120 of the first and second rails 114, 116 are circumferentially aligned with each other so the dovetails 128, 132 can be inserted into the slots 154, 156 at the same time. After a first fuel injector component 122 is in the slots 154, 156, it can be slid circumferentially clear of the access portions 118, 120 to free them up to receive the next fuel injector portion 122. Each time a new fuel injector component 122 is inserted radially into the access portions 118, 120, it can be slide circumferentially along with all of the previously inserted fuel injector portions. A side seal 152 is also inserted along the side dove tails 136, 138 (labeled in FIG. 2) of the current fuel injector component 122 and the previously inserted fuel injector component before rotating them all circumferentially out of the way of the next fuel injector component. This seals the fuel injectors components 122 at all of the dovetails 128, 132, 136, 138 to form a sealed combustor dome of the combustor 108 as shown in FIG. 1. The process described here with reference to FIG. 3 continues until there remains a gap in the combustor dome big enough for only one final fuel injector component 122, which is inserted radially in to place through the access opening 104.

With reference now to FIG. 4, a final injector component 122 can be left in the access portions 118, 120, or can be rotated circumferentially part or all of the way into the slots 154, 156 (labeled in FIG. 3), and a final one of the side seals 152 can be inserted through the opening 104 and engaged to the first and last fuel injection components 122 installed. The engine case 102 includes an access hatch 158 sealing closure of the access opening 104 outboard of a final fuel injector component 122, and outboard of the access portions 118, 120. After the final fuel injection component 122 is in place, the access hatch 158 can be placed over the access opening, which can be sealed with a seal between the engine case 102 and the access hatch 158, and the access hatch can be secured in place with bolts where indicated by the arrows in FIG. 4.

A plurality of fuel connection ports 160, considerably smaller than the access opening 104, are defined through the engine case 102 for connection of the fuel tubes 146 of the fuel injection components 122 to an external fuel manifold 162. One of the fuel connection ports 164 is defined through the access hatch 158 for connection of the final fuel injector component 122 to the external fuel manifold 162.

Figure 5:
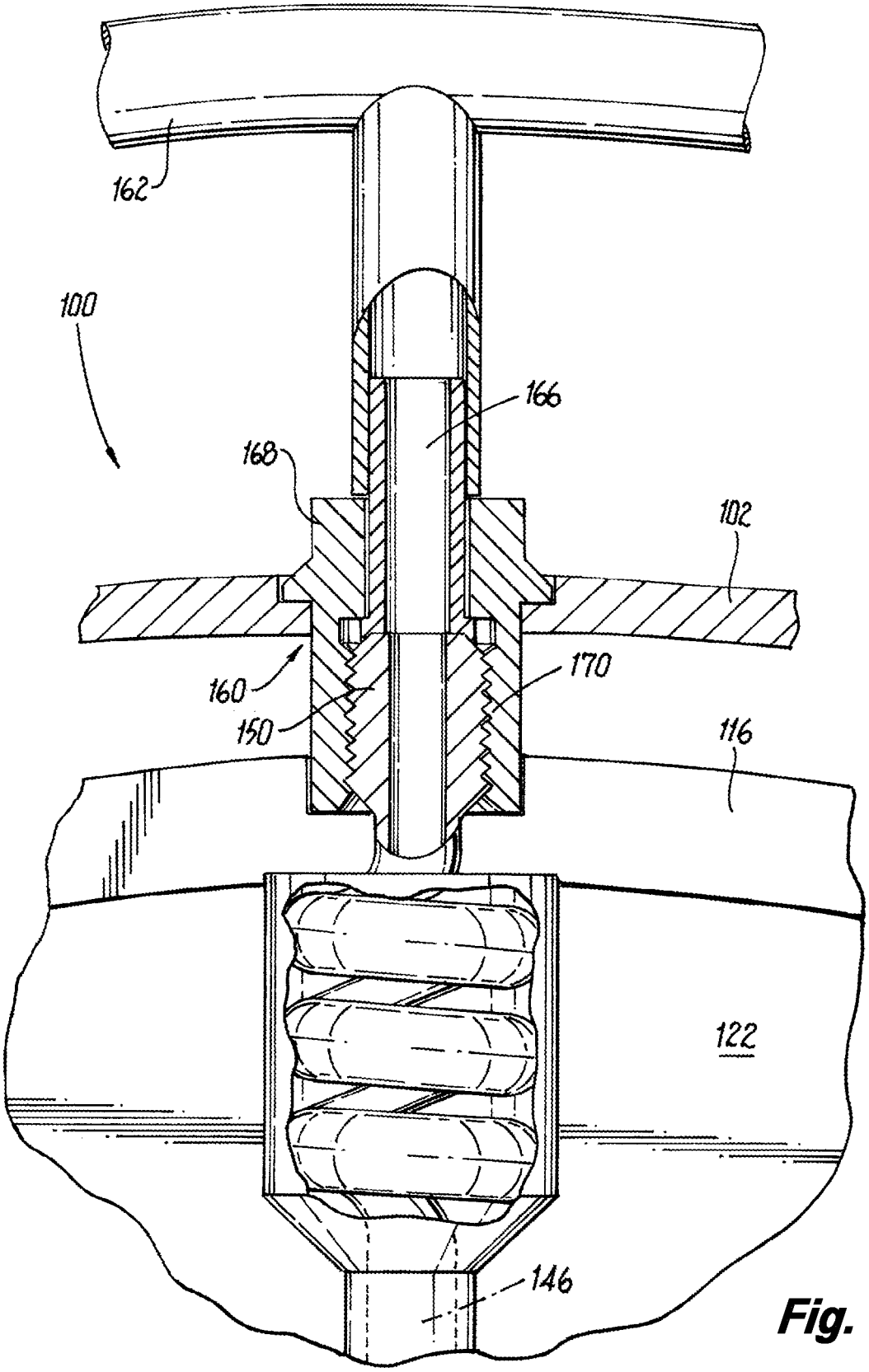
FIG. 5 is a schematic cross-sectional axial end view of a portion of the system of FIG. 1, showing engagement of one of the retaining nuts.

With reference now to FIG. 5, the external fuel manifold 162 has a respective connection branch 166 that is configured to connect to each of the fuel injector components 122 through a respective one of the fuel connection ports 160/164. A respective retaining nut 168 extends through each of the fuel connection ports 160/164. Each retaining nut 168 includes threads 170 configured to engage the threaded fuel inlet fitting 150 of one of the fuel injector components 122, and to press the fuel inlet fitting 150 into sealing engagement with one of the connection branches 166 of the external fuel manifold 162. The retaining nuts 168 can each be slid over a respective fuel manifold branch 166, e.g. before the branch 166 is itself connected to the manifold 162. Then the retaining nuts can be threaded to threads of a threaded fuel inlet fittings 150 to press the fuel inlet fitting 150 into sealing engagement with the respective connection branch 166.

The methods of assembling described above can be used for initial installation or replacement installation. A method of removing a line replaceable fuel injector component 122 runs basically in reverse from the installation methods disclosed above, opening the access hatch 158 (labeled in FIG. 4), removing the first fuel injector component 122 radially outward through the opening 104 then sliding the injector components circumferentially, relative to a longitudinal axis defined by an engine case, along a dovetail slot of a combustor wall until one is aligned with the opening 104. This includes disengaging the dovetails 128, 132 (labeled in FIG. 2) of the next fuel injector component from the dovetail slots 154, 156 (labeled in FIG. 3), and removing that fuel injector component radially outward through an access opening through the engine case, relative to a longitudinal axis defined by the engine case. This process can be repeated until all of the fuel injector components 122 have been removed.

Systems and methods as disclosed herein provide potential benefits including the following. Systems and methods as disclose herein provide a way of supporting the fuel injector in which the injector is integrated into a dome panel, and the dome panels sit within and are supported by the combustor liner. This can facilitate line replacement of LRU fuel injector components. It can also provide for a much stronger case than if each panel had its own access hatch.

The methods and systems of the present disclosure, as described above and shown in the drawings, provide for line replaceable fuel injection components in gas turbine engines. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising:

an engine case for a gas turbine engine defined around a longitudinal axis, wherein an access opening is defined through the engine case for access from outside the engine case to a space inside the engine case; and a combustor housed in the space inside the engine case, wherein the combustor includes an inner annular wall and an outer annular wall radially outboard from the inner annular wall, wherein the inner annular wall includes a first rail on an upstream end thereof, wherein the outer annular wall includes a second rail on an upstream end thereof, and wherein the first and second rails each include a respective access portion configured to receive line replaceable injector components from through the access opening of the engine case into the first and second rails to form a combustor dome of the combustor;

a plurality of fuel injector components assembled across the first and second rails to form a combustor dome at an upstream end of a combustion space defined between the inner and outer annular walls of the combustor;

wherein the engine case includes an access hatch sealing closure of the access opening outboard of a final fuel injector component of the fuel injector components, wherein a plurality of fuel connection ports are defined through the engine case for connection of a plurality of fuel tubes of the fuel injection components to an external fuel manifold.

2. A system as recited in claim 1, wherein the access opening of the engine case and the fuel injector components are configured so that the access opening is wide enough in a circumferential direction relative to the longitudinal axis to admit only one of the fuel injector components at a time.

3. The system as recited in claim 1, wherein the access portions of the first and second rails are circumferentially aligned.

4. The system as recited in claim 1, further comprising a plurality of side seals.

5. The system as recited in claim 1, further comprising the external fuel manifold with a respective connection branch configured to connect to each of the fuel injector components through a respective one of the fuel connection ports.

6. The system as recited in claim 5, further comprising a respective retaining nut extending through each of the fuel connection ports, wherein each retaining nut includes threads configured to engage the threaded fuel inlet fitting of one of the fuel injector components, and to press the fuel inlet fitting into sealing engagement with one of the connection branches of the external fuel manifold.

7. The system as recited in claim 4, wherein one of the side seals is sealingly engaged to a first side dovetail of one of the fuel injector components and to a second side dovetail of a circumferentially adjacent one of the fuel injector components.

8. The system as recited in claim 1, wherein one of the fuel connection ports is defined through the access hatch for connection of the final fuel injector component to the external fuel manifold.

* * * * *